US011745312B2

(12) United States Patent
Yasuda et al.

(10) Patent No.: US 11,745,312 B2
(45) Date of Patent: Sep. 5, 2023

(54) CLAMPING DEVICE

(71) Applicant: HONDA MOTOR CO., LTD., Tokyo (JP)

(72) Inventors: Masahiro Yasuda, Tokyo (JP); Takuya Kawashima, Tokyo (JP); Atsushi Yusa, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/671,614

(22) Filed: Feb. 15, 2022

(65) Prior Publication Data

US 2022/0266424 A1 Aug. 25, 2022

(30) Foreign Application Priority Data

Feb. 22, 2021 (JP) ..... 2021-026521

(51) Int. Cl.
*B25B 5/06* (2006.01)
*B25B 5/16* (2006.01)

(52) U.S. Cl.
CPC ..... *B25B 5/06* (2013.01); *B25B 5/166* (2013.01)

(58) Field of Classification Search
CPC .. B25B 5/06; B25B 5/166; B25B 5/08; B66B 5/22; B26D 7/01; B26D 7/02
USPC ..... 269/157, 138, 234
See application file for complete search history.

(56) References Cited

U.S. PATENT DOCUMENTS 5,363,942 A * 11/1994 Osada ..... B66B 5/22 188/170
5,979,615 A * 11/1999 Thompson ..... F16D 63/008 188/251 A
2017/0291225 A1 10/2017 Yamamoto et al.

FOREIGN PATENT DOCUMENTS

CN 106604797 A 4/2017
JP H04035893 A 2/1992
JP H06255949 A 9/1994

OTHER PUBLICATIONS

Office Action issued in the CN Patent Application No. 202210146311.3, dated Apr. 27, 2023.

* cited by examiner

*Primary Examiner* — Don M Anderson
*Assistant Examiner* — Caleb Andrew Holizna
(74) *Attorney, Agent, or Firm* — CKC & Partners Co., LLC

(57) ABSTRACT

The clamping device includes a pair of clamping members arranged in positions to clamp a rib (target portion to be clamped) of a workpiece and having contact surfaces to make contact with the rib; supports configured to support each of the pair of clamping members so as to be able to advance and retreat along a prescribed advancing/retreating direction relative to the rib, and to operate each of the pair of clamping members so as to clamp the rib when advancing; guiding units configured to make each of the pair of clamping members movable in a prescribed positioning direction due to a reaction force occurring when the pair of clamping members clamp the rib; and coil springs (biasing members) configured to elastically bias the pair of clamping members in a direction opposite the positioning direction, thereby capable of positioning the workpiece with high precision without damaging the workpiece.

7 Claims, 6 Drawing Sheets

CLAMPING DEVICE

This application is based on and claims the benefit of priority from Japanese Patent Application No. 2021-026521, filed on 22 Feb. 2021, the content of which is incorporated herein by reference.

BACKGROUND OF THE INVENTION

Field of the Invention

The present invention relates to a clamping device.

Related Art

Conventionally, workpieces are positioned and fixed in a prescribed position in order to perform a specific process or work with respect to the workpiece. For example, Patent Document 1 describes a trimming device for cutting off unneeded portions of a cover of an instrument panel for an automobile, wherein a resin molded article is positioned in a prescribed position by being supported from below and being pressed from above by a pressing means.

Patent Document 1: Japanese Unexamined Patent Application, Publication No. H04-35893

SUMMARY OF THE INVENTION

When a workpiece is pressed from above by a pressing means, there is a risk of the upper surface of the workpiece being damaged, which is particularly inconvenient when the upper surface has a design. A method could therefore be contemplated in which the workpiece's rear surface, which is not a designed surface, is held by a vacuum chuck. However, workpieces with complex, uneven surfaces, such as the instrument panel mentioned above, have few flat portions that can be held with a vacuum chuck, making it difficult to reliably hold the workpiece.

The present invention has an object of providing a clamping device that can position a workpiece with high precision without damaging the workpiece.

(1) The clamping device according to the present invention is a clamping device configured to clamp a target portion of a workpiece to position and fix the workpiece in a prescribed position, the clamping device including: a pair of clamping members arranged in positions to clamp the target portion and having contact surfaces to make contact with the target portion; supports configured to support each of the pair of clamping members so as to be able to advance and retreat along a prescribed advancing/retreating direction relative to the target portion, and to operate each of the pair of clamping members so as to clamp the target portion when advancing; guiding units configured to make each of the pair of clamping members movable in a prescribed positioning direction due to a reaction force occurring when the pair of clamping members clamp the target portion; and biasing members configured to elastically bias the pair of clamping members in a direction opposite the positioning direction.

(2) The clamping device according to (1) above includes an aspect wherein the guiding units include: a first inclined face provided to a face on a retreating side of the clamping member and being inclined relative to the direction of the reaction force; and a second inclined face provided to the support and facing the first inclined face, wherein the clamping members are moved in the positioning direction due to the first inclined face sliding along the second inclined face.

(3) The clamping device according to (1) above includes an aspect wherein the supports have opposing faces that face an end in a movement direction of the clamping members moving in the positioning direction and form gaps between the opposing faces and the clamping members, in which gaps are arranged adjusting members that adjust a movement distance of the clamping members.

(4) The clamping device according to (1) above includes an aspect wherein the contact surfaces of the clamping members are constituted by friction surfaces.

(5) The clamping device according to (1) above includes an aspect wherein the workpiece is an instrument panel for an automobile, having a surface side that is a design surface and a rear surface side that is not a design surface, the target portion being a rib protruding from the rear surface, the clamping device further including a base configured to hold the workpiece, the positioning direction being a direction from the workpiece toward the base, and the biasing members biasing the workpiece in a direction away from the base.

According to the present invention, it is possible to provide a clamping device that can position a workpiece with high precision without damaging the workpiece.

DETAILED DESCRIPTION OF THE INVENTION

Figure 1:
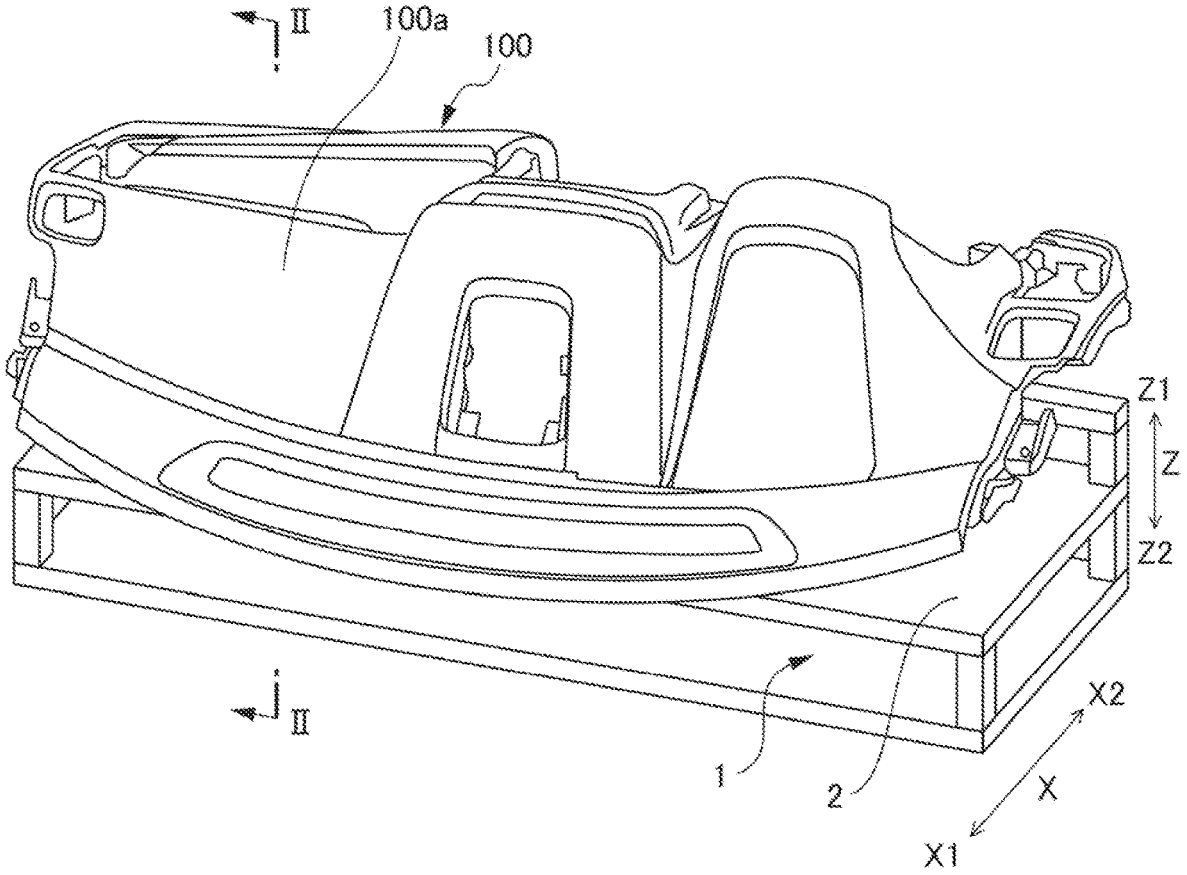
FIG. 1 is a perspective view illustrating a workpiece (instrument panel) set in a clamping device according to an embodiment of the present invention.
Figure 2:
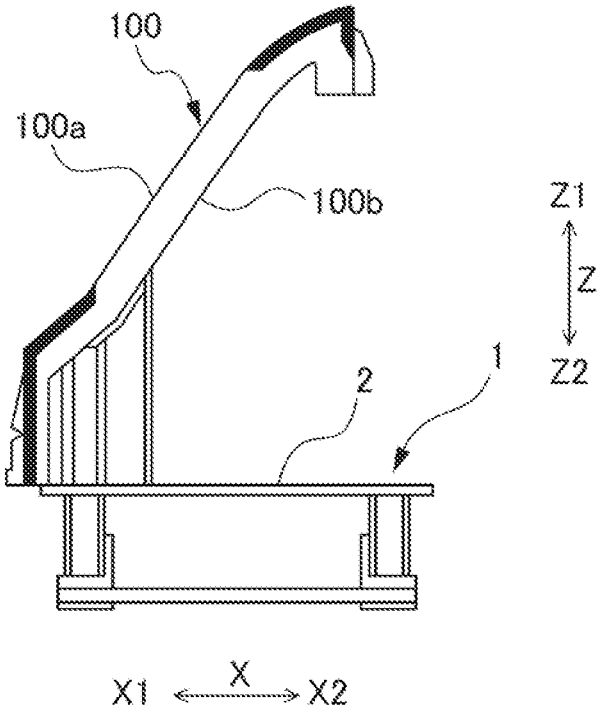
FIG. 2 schematically illustrates a cross-section taken along line II-II in FIG. 1.

An embodiment of the present invention is described below with reference to the drawings. FIG. 1 is a perspective view illustrating a workpiece 100 set in a clamping device 1 according to the present embodiment, and FIG. 2 is a cross-sectional view taken along line II-II in FIG. 1. The workpiece 100 according to the present embodiment is a resin molded article, and is an instrument panel of an automobile. The workpiece 100 is placed on a base 2 of the clamping device 1 and positioned, so that a specific process can be performed on the workpiece. The process may be, for example, cutting off (trimming) unneeded portions of a covering of the instrument panel, etc.

Figure 3:
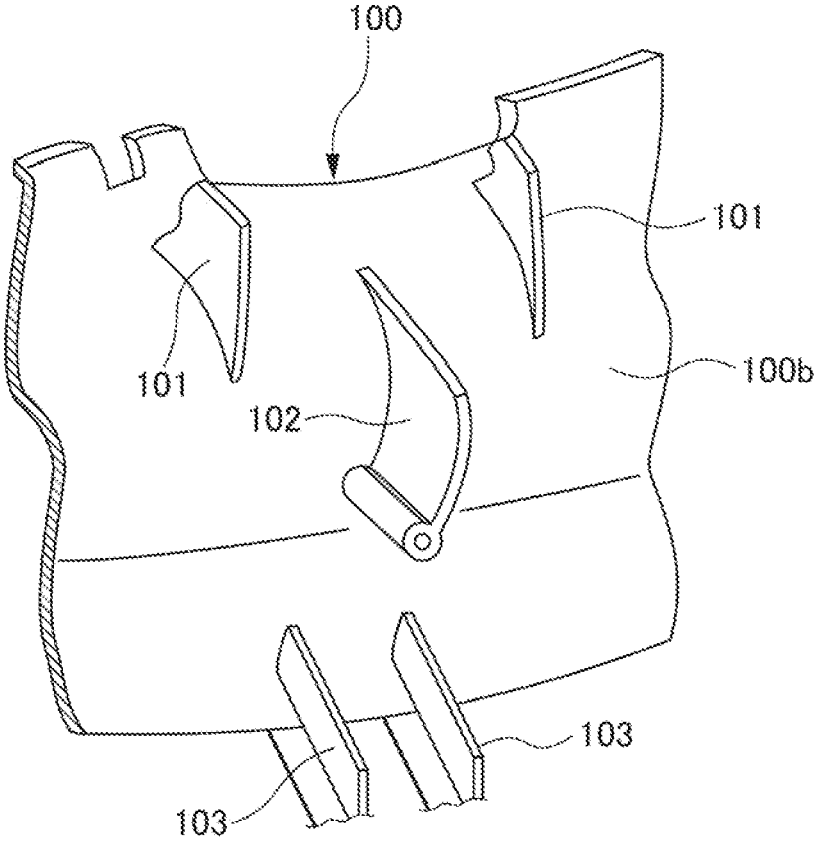
FIG. 3 is a perspective view of part of the workpiece, illustrating a rear surface of the workpiece.

A surface 100*a* of the workpiece 100 is a designed surface, which has a design thereon. FIG. 3 is a partial view of the workpiece 100 seen from a rear surface 100*b* side. The rear surface 100*b* of the workpiece 100 is a non-designed surface, which does not have a design. A plurality of ribs 101, 102, 103 are formed on the rear surface 100*b* of the workpiece 100. Each of the plurality of ribs 101, 102, 103 are formed in one piece with the workpiece 100 in order to reinforce the workpiece 100 and maintain the molded shape.

Figure 4:
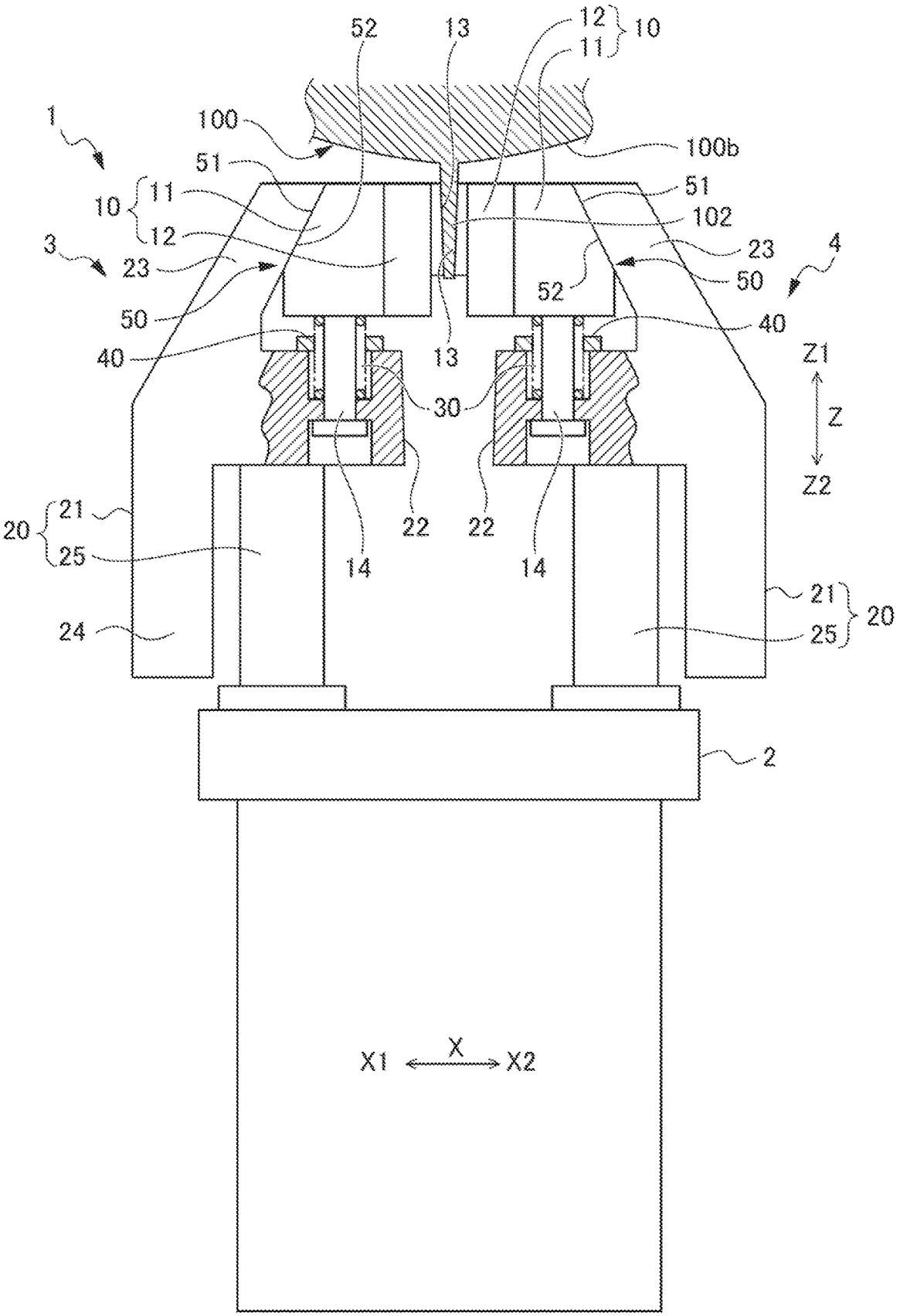
FIG. 4 is a front view illustrating a clamping device according to an embodiment of the present invention.

FIG. 4 is a front view of the clamping device 1 according to the present embodiment. The clamping device 1 clamps the rib 102 as a target portion formed on the rear surface side of the workpiece 100 as illustrated, for example, in FIG. 3, to position and fix the workpiece 100 in a prescribed position. Here, the arrow X in FIG. 1, FIG. 2, and FIG. 4 indicates a left-right direction of the clamping device 1, wherein X1 is the left direction and X2 is the right direction. In addition, the arrow Z in FIG. 1, FIG. 2, and FIG. 4 indicates an up-down direction of the clamping device 1, wherein Z1 is the up direction and Z2 is the down direction. The same arrow indications are used in FIG. 5 and FIG. 6 described below.

As illustrated in FIG. 4, the clamping device 1 includes the base 2, and a first clamping mechanism 3 and a second clamping mechanism 4 arranged on the left and right on the base 2. The workpiece 100 is held in a specific orientation on the base 2. The workpiece 100 is arranged on the base 2 with the rear surface 100*b* facing down. In this state, the rib 102 protrudes downwardly. In the present embodiment, the downward direction in which the rib 102 protrudes is considered a positioning direction of the workpiece 100.

It should be noted that the first clamping mechanism 3 and the second clamping mechanism 4 are not limited to one pair, and that a plurality of pairs may be arranged on the base 2 as necessary. In FIG. 2, illustration of the first clamping mechanism 3 and the second clamping mechanism 4 is omitted.

The first clamping mechanism 3 and the second clamping mechanism 4 are configured such that the same components are arranged in left-right symmetry with one another. Accordingly, the first clamping mechanism 3 is described herein, while description of the second clamping mechanism 4 is omitted. Identical components are given identical reference numerals.

The first clamping mechanism 3 includes a clamping member 10, a support 20 supporting the clamping member 10, a coil spring 30 as a biasing member, a shim 40 as an adjusting member, and a guiding unit 50.

The clamping member 10 is arranged in a position to clamp the rib 102 of the workpiece 100 held on the base 2, in cooperation with a clamping member 10 on the second clamping mechanism 4 side. The clamping member 10 of the first clamping mechanism 3 is arranged on the left side of the rib 102, and the clamping member 10 of the second clamping mechanism 4 is arranged on the right side of the rib 102.

The clamping member 10 includes a main unit 11 and an end unit 12 fixed to the main unit 11. The end unit 12 has a contact surface 13 facing the rib 102 to be brought into contact with the rib 102. The contact surface 13 is composed of a friction surface in order to contact the rib 102 with high friction so as to reliably hold the rib 102 without being likely to slip. The friction surface is provided by forming fine irregularities in the surface by, for example, knurling, etc. A downwardly extending rod 14 is provided to a lower face of the main unit 11. The rod 14 is inserted into the support 20 so as to be slidable in the up-down direction. In other words, the clamping member 10 is supported by the support 20 via the rod 14 so as to be movable in the up-down direction.

The support 20 includes a support block 21 into which the rod 14 is inserted, and a drive unit 25 that moves the support block 21 in the left-right direction. The support block 21 essentially has three portions in the up-down direction. Specifically, the support block 21 has a base portion 22 in the center of the up-down direction, an upper inclined portion 23 extending upwardly and inclined to the right from the outside end of the base portion 22 (the left side of the first clamping mechanism 3), and a lower extending portion 24 extending downwardly from the outside end of the base portion 22.

Figure 5:
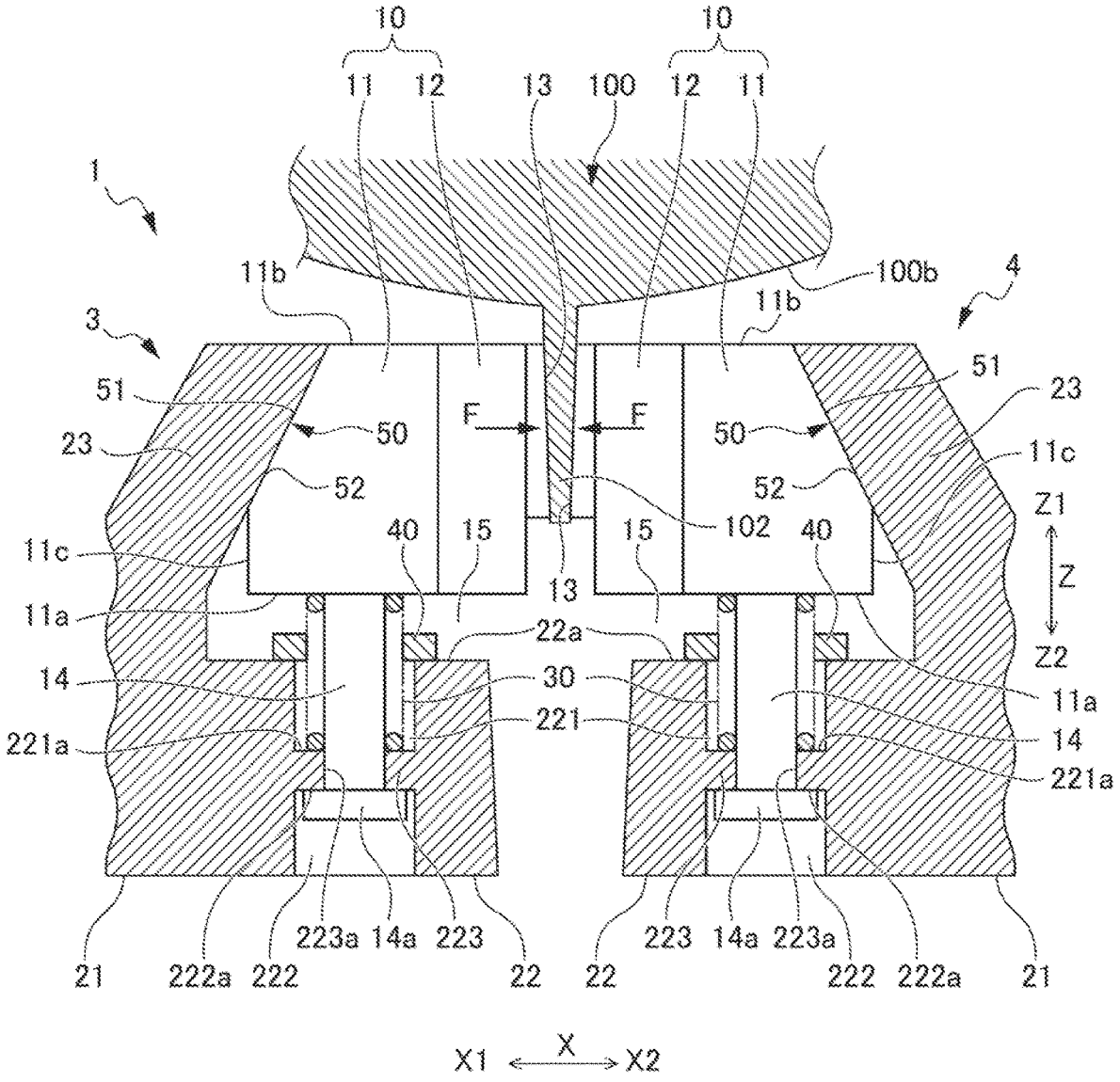
FIG. 5 is a partial cross-sectional view illustrating the essential parts of a clamping device according to an embodiment of the present invention.
Figure 6:
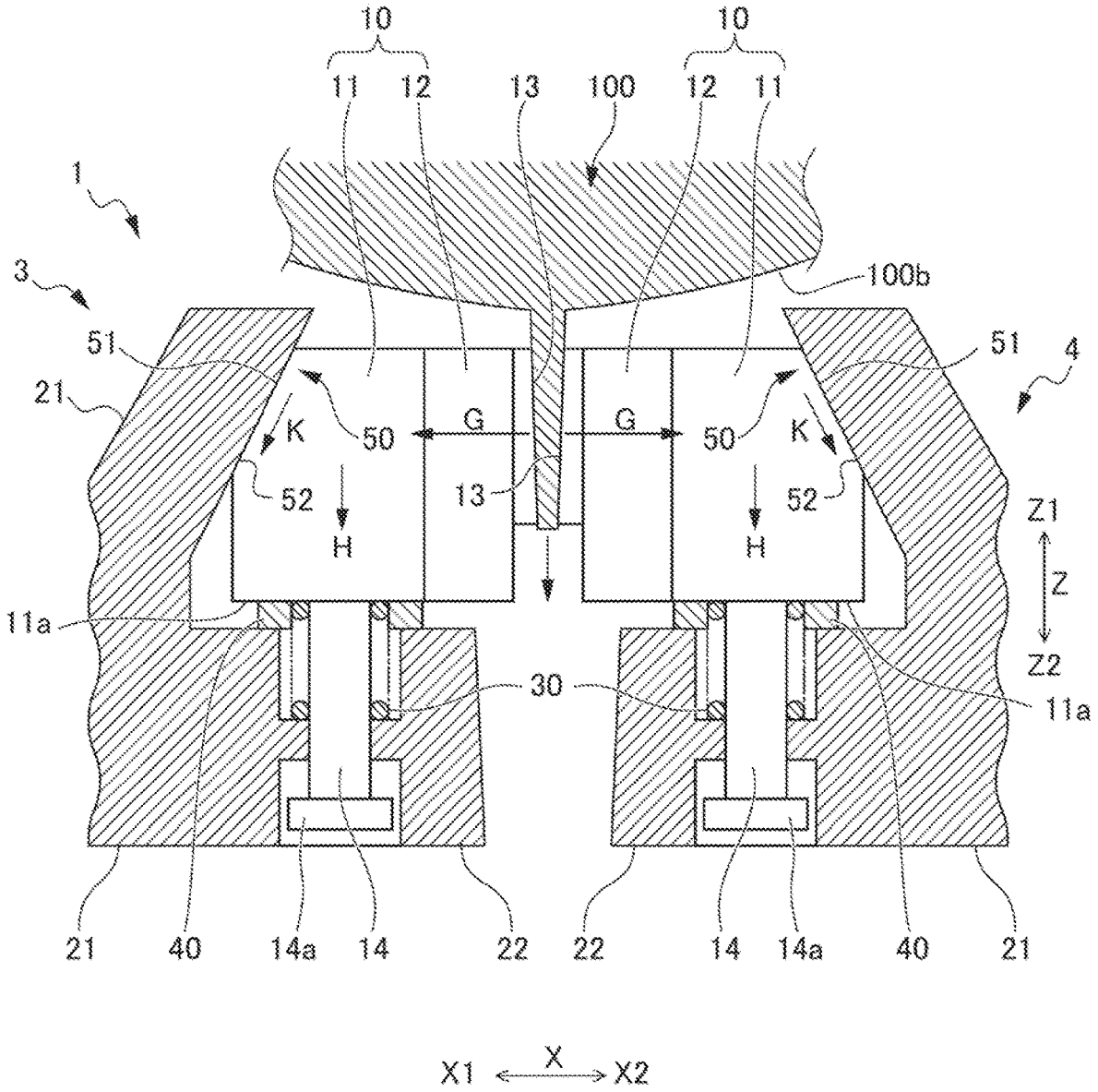
FIG. 6 is a partial cross-sectional view illustrating, the essential parts of a clamping device according to an embodiment of the present invention, and illustrates an operation of a guiding unit.

FIG. 5 illustrates the portion of the clamping member 10 being supported by the support block 21 and the surroundings. As illustrated in FIG. 5, the base portion 22 of the support block 21 has an upper recess 221 opened in the upper face, and a lower recess 222 opened in the lower face. The upper recess 221 and the lower recess 222 are arranged coaxially in the up-down direction, and a partition 223 is provided between them. A hole 223*a* is provided penetrating the partition 223 in the up-down direction, and the rod 14 is inserted into the hole 223*a* so as to be slidable in the up-down direction. The rod 14 has a flange 14*a* at its end.

The coil spring 30 is arranged inside the upper recess 221 in a state of being coiled around the rod 14. The coil spring 30 is a compression spring that is in a compressed state between a lower face 11*a* of the main unit 11 of the clamping member 10 and a bottom face 221*a* of the upper recess 221. The coil spring 30 elastically biases the clamping member 10 upwardly, in other words in a direction opposite the downward direction, which is the positioning direction. Further upward movement of the clamping member 10 is restricted by the flange 14*a* of the rod 14 contacting an upper face 222*a* of the lower recess 222. Conversely, the clamping member 10 is able to move downwardly against the force of the coil spring 30.

The end in the downward movement direction of the main unit 11 of the clamping member 10, that is to say the lower face 11*a* of the main unit 11, and an upper face 22*a* of the base portion 22 of the support block 21, face each other across a gap 15. The upper face 22*a* of the base portion 22 of the support block 21 constitutes an opposing face of the present invention. The shim 40 that adjusts the movement distance of the clamping member 10 in the up-down direction is arranged in the gap 15.

The shim 40 is an annular member arranged with the rod 14 penetrating the center of the shim 40, and is arranged on the upper side 22*a* side of the base portion 22. When the clamping member 10 moves downwardly, the downward movement distance is adjusted by the lower face 11*a* of the main unit 11 contacting the shim 40. In other words, by adjusting the thickness of the shim 40, the downward movement distance of the clamping member 10 can be adjusted. The shim 40 is preferably made of a material, such as hard rubber or a hard resin, which is able to ensure the gap 15 without damaging the portions in contact with the shim 40 (the main unit 11 and the support block 21), and without being crushed.

As illustrated in FIG. 4, the drive unit 25 is arranged on the base 2. The drive unit 25 is arranged so as to be movable in the left-right direction on the base 2. For example, the drive unit 25 is provided so as to be movable along a rail (not illustrated) provided extending in the left-right direction on the base 2. The drive unit 25 is configured to move in the left-right direction by means of a driving source (not illustrated) such as a motor, etc. Alternatively, the drive unit 25 may be configured to be manually movable in the left-right direction, and lockable in a stopping position.

The base portion 22 of the support block 21 is fixed to an upper end of the drive unit 25. In this way, the clamping member 10 is made to move in the left-right direction by the drive unit 25, so as to approach or retreat from the rib 102. The clamping member 10 is made to advance by the drive unit 25 and the contact surface 13 contacts the rib 102. The contact surface 13 of the clamping member 10 on the second clamping mechanism 4 side also contacts the rib 102. The contact surfaces 13 of the clamping members 10 of both the first clamping mechanism 3 and the second clamping mechanism 4 contact and press the rib 102, whereby the rib 102 is clamped. It is preferable that the clamping members 10 approach or retreat from the rib 102 in a synchronized manner. The drive units 25 operate the clamping members 10 so that the clamping members 10 clamp the rib 102.

The guiding units 50 render the clamping members 10 movable in a downward direction, which is the positioning direction along the protrusion direction of the rib 102, by means of a reaction force occurring when the clamping members 10 of the first clamping mechanism 3 and the second clamping mechanism 4 clamp the rib 102.

The guiding unit 50 according to the present embodiment includes a first inclined face 51 provided to the clamping member 10 and a second inclined face 52 provided to the support block 21. The first inclined face 51 is formed on the outside face (the left side in the first clamping mechanism 3 and the right side in the second clamping mechanism 4), which is on the retreating side of the clamping member 10 relative to the rib 102. As illustrated in FIG. 5, the first inclined face 51 inclines so as to gradually separate from the end unit 12 toward a side face 11*c* which is on the outside relative to an upper face lib of the main unit 11 of the clamping member 10. The first inclined face 51 is inclined relative to the downward direction which is the positioning direction of the present embodiment, and the left-right direction, and follows a direction orthogonal to the plane of the drawing as illustrated in FIG. 4.

The second inclined face 52 is formed on a face on the inside (on the right side in the first clamping mechanism 3 and on the left side in the second clamping mechanism 4) of the upper inclined portion 23 of the support block 21. The second inclined face 52 is parallel with and faces the first inclined face 51, and is in relatively slidable contact with the first inclined face 51. The force of the left and right pair of clamping members 10 pressing against and clamping the rib 102 is transmitted from the second inclined faces 52 of the support blocks 21 to the first inclined faces 51 of the clamping members 10.

As illustrated in FIG. 5, the left and right pair of clamping members 10 press against and clamp the rib 102 in the directions indicated by the arrows F. In the guiding unit 50, when the clamping members 10 of the first clamping mechanism 3 and the second mechanism 4 clamp the rib 102, the clamping members 10 receive a reaction force (indicated by the arrows G in FIG. 6) directed outwardly (away from the rib 102). This causes the first inclined faces 51 of the clamping members 10 to press against the second inclined faces 52 of the support blocks 21 in an outward direction.

The first inclined faces 51 and the second inclined faces 52 are all inclined relative to the direction of the reaction force G. The pressing force of the first inclined faces 51 pressing against the second inclined faces 52 due to the reaction force G causes a component force (indicated by the arrows H in FIG. 6) due to the first inclined faces 51 being in contact with the second inclined faces 52, which causes the clamping members 10 to move downwardly. When the component force H exceeds the biasing force of the coil springs 30, the first inclined faces 51 slide against the second inclined faces 52 (indicated by the arrows K in FIG. 6), whereby the clamping members 10 move downwardly. Therefore, as the clamping members 10 strongly clamp the rib 102, the clamping members 10 are caused to move downwardly by the guiding units 50, which causes the rib 102 clamped by the clamping members 10 to also move downwardly, whereby the workpiece 100 which is in one piece with the rib 102 moves downwardly.

The clamping member 10 moves downwardly until the lower face 11*a* of the main unit 11 contacts the shim 40. Thus, the workpiece 100 is positioned and fixed in a position at a downward movement distance that has been adjusted in advance by the shim 40. In the present embodiment, the downward movement distance adjusted by the shim 40 is set to be equal to an amount of rise of the workpiece 100 relative to the base 2. Specifically, when the workpiece 100 moves downwardly, a specific location of the workpiece 100 contacts a specific seating surface of the base 2, whereby rising of the workpiece 100 is suppressed. The workpiece 100 is thus positioned on the base 2. With the workpiece 100 thus positioned, processes such as, for example, cutting off unneeded portions of a cover of an instrument panel as described above can be performed precisely.

The clamping device 1 according to the embodiment described above exhibits the following effects.

(1) The clamping device 1 according to the present embodiment is a clamping device 1 configured to clamp a rib 102 of a workpiece 100 to position and fix the workpiece 100 in a prescribed position, the clamping device including: a pair of clamping members 10 arranged in positions to clamp the rib 102 and having contact surfaces 13 to make contact with the rib 102; supports 20 configured to support each of the pair of clamping members 10 so as to be able to advance and retreat along a prescribed advancing/retreating direction relative to the rib 102, and to operate each of the pair of clamping members 10 so as to clamp the rib 102 when advancing; guiding units 50 configured to make each of the pair of clamping members 10 movable in a prescribed positioning direction due to a reaction force occurring when the pair of clamping members 10 clamp the rib 102; and coil springs 30 configured to elastically bias the pair of clamping members 10 in a direction opposite the positioning direction.

Thus, as the pair of clamping members 10 clamp the rib 102, the pair of clamping members 10 are caused to move downwardly by the guiding units 50, which causes the rib 102 clamped by the clamping members 10 to also move downwardly, whereby the workpiece 100 which is in one piece with the rib 102 moves downwardly and is positioned. Because the workpiece 100 is positioned as the rib 102 is clamped, the workpiece 100 can be positioned along the protrusion direction of the rib 102 with high precision without damage to the workpiece 100. In addition, because there is no need for a power source to move the rib 102 in the positioning direction, the device can be configured simply and at a low cost.

(2) The clamping device 1 according to the present embodiment includes an aspect wherein the guiding units 50 include a first inclined face 51 provided to a face on a retreating side of the clamping member 10 and being inclined relative to the direction of the reaction force; and a second inclined face 52 provided to the support 20 and facing the first inclined face 51, wherein the clamping members 10 are moved in the positioning direction due to the first inclined face 51 sliding along the second inclined face 52.

This allows for the operation of the guiding units 50 to be achieved with a simple configuration.

(3) In the clamping device 1 according to the present embodiment, it is preferable that the supports 20 have upper faces 22*a* that face lower faces 11*a*, which are ends in a movement direction of the clamping members 10 moving in the positioning direction, and form gaps 15 between the upper faces 22*a* and the clamping members 10, in which gaps 15 are arranged shims 40 that adjust a movement distance of the clamping members 10.

This allows for a movement amount of the workpiece 100 in the positioning direction to be adjusted by the thickness of the shims 40, making it possible to position the workpiece 100 in any position safely and without damage.

(4) In the clamping device 1 according to the present embodiment, it is preferable that the contact surfaces 13 of the clamping members 10 are constituted by friction surfaces.

This allows for the rib 102 to be clamped reliably without slipping, making it possible to smoothly position the workpiece 100.

(5) In the clamping device 1 according to the present embodiment, the workpiece 100 is an instrument panel for an automobile, having a surface 100*a* side that is a design surface and a rear surface 100*b* side that is not a design surface, the clamped member being a rib 102 protruding from the rear surface 100*b* of the workpiece 100, the clamping device 1 further comprising a base 2 configured to hold the workpiece 100, the positioning direction being a direction from the workpiece 100 toward the base 2, and the coil springs 30 biasing the workpiece 100 upwardly away from the base 2.

Thus, when, for example, performing a process of cutting off (trimming) unneeded portions of a cover of an instrument panel for an automobile, setting the instrument panel in the clamping device 1 of the present embodiment and positioning as described above allows for the process to be performed with high precision. If the instrument panel has a complex, uneven surface with few flat portions, the positions in which positioning means such as a vacuum chuck which utilizes flat surfaces can hold the instrument panel are limited, and the holding power is weak. However, in the present embodiment the rib 102 is positioned by being clamped and pulled toward the base 2, which makes the holding power strong, and effectively prevents the workpiece from rising from the base 2. In a case where vacuum chucks are used in combination, the number of vacuum chucks can be reduced.

An embodiment of the present invention has been described above, but the present invention is not limited to the above embodiment, and includes various modifications and improvements, etc. within the scope in which the object of the present invention can be achieved. For example, the positioning direction is not limited to the protrusion direction of the rib 102, and may be a direction intersecting the protrusion direction. The guiding unit 50 need only be able to make the rib 102 movable in the positioning direction. The workpiece 100 is not limited to the instrument panel of an automobile, and may be anything that requires positioning for a prescribed process.

EXPLANATION OF REFERENCE NUMERALS

1 Clamping device
2 Base
10 Clamping member
13 Contact surface
15 Gap
20 Support
22*a* Upper face (opposing face)
30 Coil spring (biasing member)
40 Shim (adjusting member)
50 Guiding unit
51 First inclined face
52 Second inclined face
100 Workpiece (instrument panel)
100*a* Workpiece surface
100*b* Workpiece rear surface
102 Rib (target portion to be clamped)

What is claimed is:

1. A clamping device configured to clamp a target portion of a workpiece to position and fix the workpiece in a prescribed position, the clamping device comprising:

a pair of clamping members arranged in positions to clamp the target portion and having contact surfaces to make contact with the target portion;

supports configured to support each of the pair of clamping members so as to be able to advance and retreat along a prescribed advancing/retreating direction relative to the target portion, and to operate each of the pair of clamping members so as to clamp the target portion when advancing;

guiding units configured to make each of the pair of clamping members movable in a prescribed positioning direction due to a reaction force occurring when the pair of clamping members clamp the target portion; and biasing members configured to elastically bias the pair of clamping members in a direction opposite the positioning direction, wherein the guiding units include:

a first inclined face provided to a face on a retreating side of the clamping member and being inclined relative to the direction of the reaction force; and a second inclined face provided to the support and facing the first inclined face, wherein the clamping members are moved in the positioning direction due to the first inclined face sliding along the second inclined face, wherein the first inclined face and the second inclined face are configured to slide in direct contact.

2. The clamping device according to claim 1, wherein the supports have opposing faces that face an end in a movement direction of the clamping members moving in the positioning direction and form gaps between the opposing faces and the clamping members, in which adjusting members that adjust a movement distance of the clamping members are arranged in the gaps.

3. The clamping device according to claim 1, wherein the contact surfaces of the clamping members are constituted by friction surfaces.

4. The clamping device according to claim 1, wherein the workpiece is an instrument panel for an automobile, having a surface side that is a design surface and a rear surface side that is not a design surface, the target portion being a rib protruding from the rear surface, the clamping device further comprising a base configured to hold the workpiece, the positioning direction being a direction from the workpiece toward the base, and the biasing members biasing the workpiece in a direction away from the base.

5. The clamping device according to claim 1, further comprising a pair of shims, and wherein:

the positioning direction of the clamping members is in an up-down direction that is perpendicular to the left-right direction, and the advancing/retreating direction of the clamping members is at an angle to the positioning direction of the clamping members;

each of the clamping members comprises a lower face that extends in the left-right direction;

each of the supports comprises an upper face that extends in the left-right direction;

each of the shims is disposed on the upper face of one of the supports, said each of the shims opposing the lower face of a corresponding one of the clamping members; and downward movement of each of the clamping members in the positioning direction is stopped when the lower face of said each of the clamping members contacts a corresponding one of the shims.

6. The clamping device according to claim 5, further comprising a pair of coil springs, wherein:

each of the coil springs is disposed between the lower face of one of the clamping members and a corresponding one of the supports; and each of the shims surrounds a portion of one of the coil springs.

7. The clamping device according to claim 6, wherein:

an upper recess is formed in each of the supports extending downwardly from the upper face of said each of the supports and ending at a bottom face; and a top of each of the coil springs abuts against the lower face of one of the clamping members, and a bottom of said each of the coil springs abuts against the bottom face of a corresponding one of the upper recesses.

* * * * *